United States Patent [19]

Hori et al.

[11] 4,352,576

[45] Oct. 5, 1982

[54] SERIAL PRINTER HAVING A SINGLE DRIVE MOTOR

[75] Inventors: Fumihisa Hori; Tadao Tamukai, both of Tamayama; Mikio Miyajima, Nishine, all of Japan

[73] Assignee: Alps Patent Department, Tokyo, Japan

[21] Appl. No.: 166,774

[22] Filed: Jul. 8, 1980

[30] Foreign Application Priority Data

Jul. 9, 1979 [JP] Japan ..... 54-86756

[51] Int. Cl.[3] ..... B41J 9/02; B41J 9/38; B41J 19/72

[52] U.S. Cl. ..... 400/154.4; 101/93.17; 400/155; 400/158; 400/317.2

[58] Field of Search ..... 101/93.15, 93.17, 93.21, 101/95, 99; 400/185, 154, 154.1, 154.4, 155, 158, 317.2; 178/28, 29

[56] References Cited

U.S. PATENT DOCUMENTS

| | | | |
|---|---|---|---|
| 1,229,202 | 6/1917 | Potts | 400/154.1 X |
| 1,334,687 | 3/1920 | Wilson . | |
| 2,294,688 | 9/1942 | Nichols | 400/154.1 |
| 3,310,147 | 3/1967 | Clary et al. | 197/55 |
| 3,690,249 | 9/1972 | Nihira et al. | 101/95 |
| 3,795,300 | 3/1974 | Matsuzawa | 101/93.17 X |
| 3,972,280 | 8/1976 | Swatik et al. | 101/93.16 |
| 4,051,942 | 10/1977 | Suzuki et al. | 400/154.5 X |
| 4,054,089 | 10/1977 | Okabe | 101/99 |
| 4,104,967 | 8/1978 | Okabe | 101/99 |

FOREIGN PATENT DOCUMENTS

| | | |
|---|---|---|
| 944951 | 12/1963 | United Kingdom . |
| 1252393 | 11/1971 | United Kingdom . |
| 1266004 | 3/1972 | United Kingdom . |

*Primary Examiner*—Edgar S. Burr

*Attorney, Agent, or Firm*—Guy W. Shoup; Gerard F. Dunne

[57] ABSTRACT

A printer having clutches for selectively transmitting the driving power from a single motor to a rotary shaft for rotating the type wheels and to a hammer drive shaft for driving a hammer is described. The clutches are under the control of a single controlling member so that the typing operation can be accomplished by the power furnished by a single motor having a shaft which need rotate continuously in one direction only.

8 Claims, 13 Drawing Figures

SERIAL PRINTER HAVING A SINGLE DRIVE MOTOR

BACKGROUND OF THE INVENTION

The present invention relates to a typing mechanism for a serial printer suitable for use in the display of desk-top calculators, measuring instruments and so forth.

Many desk-top calculators, measuring instruments and so forth proposed heretofore employ displays using liquid crystals or the like for producing a digital display. Recently, however, there have been proposed desk-top calculators and measuring instruments having a small serial printer for printing and recording on recording paper the result of calculations or measurments. The serial printers of the type described preferably have as small a size as possible because of limited space. It is often quite difficult to realize the small size desired because the serial printer has various complicated mechanisms, such as the mechanism for rotatably driving the type wheel, the mechanism for shifting the carriage, and the mechanism for driving the typing hammer, paper feed mechanism and so on.

Current desk-top calculators have various operation functions, and it is required that the calculators be able, in addition to printing the numerals 0 to 9, to print various data on the operation function, and the number of these operation functions may well correspond to that of the numeral data. If the numerals and function symbols are carried by a single type wheel, the size of the type wheel must be increased to an impractical size so that the size of the printer would be increased inconveniently to make the printer unsuitable for use in portable type desk-top calculators or the like.

In order to obviate this problem, a new serial printer has been proposed in which the type wheel for the function symbol and the type wheel for numerals are constructed separately from each other and only the type wheel having the numerals is shifted to provide the different columns of characters. As can be seen from Japanese Patent Laid-open Publication No. 46930/1977, this type of serial printer has two hammers which are associated with two type wheels and operate independently of each other. This arrangement requires a complicated mechanism for selectively actuating the two hammers by a single actuating mechanism.

Also a serial printer has been proposed in which the mechanism for selectively actuating the two hammers is eliminated and two type wheels are associated with a single common hammer so as to be selectively operated by the latter. Such a serial printer is shown in Japanese Patent Laid-open Publication No. 56514/1978.

The serial printers shown in Japanese Patent Laid-open Nos. 46930/1977 and 56514/1978 are suitable for use in desk-top calculators or the like, because they have sufficiently reduced size and weight. However, the cost of parts of the driving power source and the space occupied by the latter tend to become large, because a pulse motor is used for rotatively driving the type wheels, a solenoid plunger of a comparatively large size is used for column shift of the type wheel and driving of the hammer, and another solenoid plunger of a comparatively large size is used for feeding the paper and releasing the carriage.

On the other hand, Japanese Patent Laid-open No. 68325/1979 proposes a serial printer in which a single motor performs various actions such as selection of type, printing, column shift, paper feed and so forth. In this printer, however, there is a practical limit in increasing the typing speed, because the motor has to be reversible. For the same reason, the motor is comparatively expensive and requires a complicated control. In addition, a complicated mechanism is required for selecting and retaining the two type wheels independently.

SUMMARY OF THE INVENTION

It is, therefore, a major object of the present invention to provide a serial printer of reduced size and weight to overcome the above-described problems.

It is another object of the present invention to provide a serial printer suitable for use in a desk-top calculator of small size and weight, by reducing as much as possible the number of driving or actuating sources and, hence, the space occupied by such driving or actuating sources.

It is still another object of the present invention to improve the typing speed by maintaining a constant direction of rotation of the motor shaft while transmitting the power of the motor as required to the desired shaft through a specific clutch mechanism.

It is a further object of the invention to provide a serial printer of a size which is reduced as much as possible through decreasing the number of rotary shafts.

It is a still further object of the invention to simplifly the construction of the serial printer and to reduce the size of the same by attaching various parts to a rotary shaft to make and efficient use of the shaft.

According to the present invention, a single motor is provided to rotate either a shaft carrying two type wheels, or a shaft driving a hammer element. Respective clutches are provided for transmitting the rotation of the motor to one or the other shaft under direction of a control. Further, the shaft driving the hammer element may be connected to means for advancing a carriage carrying the type wheels along a line to be printed.

DESCRIPTION OF THE PREFERRED EMBODIMENTS

A preferred embodiment of the present invention will be described hereinunder with reference to the accompanying drawings.

Figure 1:
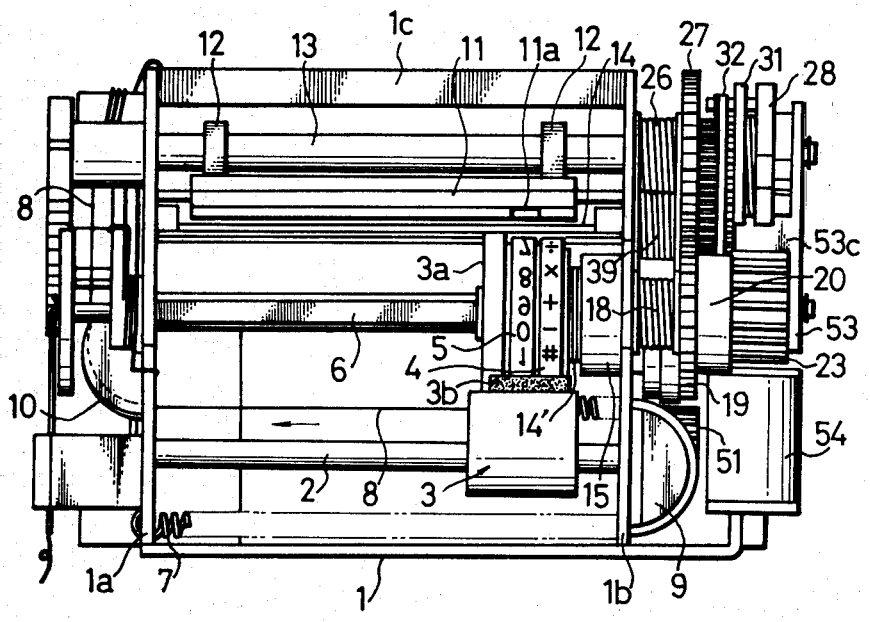
FIG. 1 is a plan view of a printer according to the present invention.

FIG. 1 is a plan view of a serial printer embodying the present invention. A reference numeral 1 denotes a frame plate of iron or the like to which are attached upright side plates 1*a* and 1*b*. The side plates 1*a* and 1*b* face one another from opposite sides of the frame plate 1 and are supported at their upper ends by a transverse supporting plate 1*c*. A rail 2 extends between the side plates 1*a* and 1*b*. A reference numeral 3 denotes a carriage which can be moved along the rail 2 to the right and left, i.e. in the direction of a line to be printed. Reference numerals 4 and 5 denote, respectively, a type wheel for printing function symbols and a type wheel for printing numerals, and these type wheels are carried by the carriage 3. The type wheels 4 and 5 are penetrated by a rotary shaft 6 so as to be driven rotatably by the latter. These type wheels are not allowed to rotate relative to the rotary shaft 6 but can move independently of each other in the axial direction therealong within respective predetermined distances.

Although not fully shown in the drawings, a tension spring 7 is fixed at its one end to the side plate 1*a* while the other end extends through the side plate 1*b* and is fixed to the outer right side wall of the carriage 3 to urge the carriage 3 to its initial position, i.e. to the position shown in FIG. 1. A reference numeral 8 denotes a wire or thread for effecting a column shift of the carriage 3 by pulling it in the direction of the arrow. Numerals 9 and 10 denote guide members for guiding the tension spring 7 and the column shift wire 8 which are attached to the side plates 1*a* and 1*b*, respectively. A reference numeral 11 denotes a typing hammer provided at its right end with a notch 11*a* for preventing typing, as will be set forth more fully below. The typing hammer 11 is adapted to be actuated by a non-circular hammer cam 12 which is attached to a drive shaft 13. A reference numeral 14 denotes a recording paper interposed between the typing hammer 11 and the type wheels 4 and 5. Numerals 3*b* and 15 designate, respectively, an ink roller and a stopper disk.

Before turning to the detailed description of the driving mechanism, a description will be made as to the printing operation.

As the rotary shaft 6 is rotated to bring the desired function symbol to the typing position, the drive shaft 13 is rotated to make the hammer cam 12 press the typing hammer 11, so that the latter presses the recording paper onto the type wheel 4 thereby to print the function symbol. In this state, no typing of the numeral is effected because the type wheel 5 is positioned within the notched part 11*a* of the hammer 11 and thus is not contacted by the hammer.

After the completion of the typing of the first column or place on a line to be printed, the column shift wire 8 is pulled in the direction of the arrow to shift the carriage 3 to the left by one column. Meanwhile, the type wheel 5 carried by the carriage arm 3*a* is shifted to the second column. On the other hand, the type wheel 4 does not follow the movement of the carriage 3 although it is shifted to the left by the action of spring 14', and is stopped at a position opposite the notched part 11*a* of the typing hammer 11. The type wheel 4 remains at this position until the carriage is returned after completion of the typing of one line. Although not shown, the type wheel 4 abuts a step formed on the shaft 6 so as to be retained by the step in a position opposite the notched part 11*a*.

The typing operation mentioned above for the first column is repeated to effect the typing of the second column after the carriage 3 is shifted to the second column and the desired numeral is brought to the typing position.

After the typing of all the characters for one line is completed, the shift wire 8 is freed. In consequence, the carriage 3 is returned to the initial position shown in FIG. 1 by the action of the tension spring 7, and the paper feed is advanced.

The typing mechanism will be described in detail hereinunder.

The typing mechanism of the serial printer of the invention has three shaft mechanisms: (1) rotary shaft mechanism for rotatably driving the type wheels 4 and 5, (2) shaft mechanism for rotatably driving a hammer cam 12 for driving a typing hammer and (3) a paper feed shaft mechanism for feeding recording paper. These mechanisms are coupled in an inter-related manner through a gear mechanism and clutches to effect the various sequence of operations.

Figure 2:
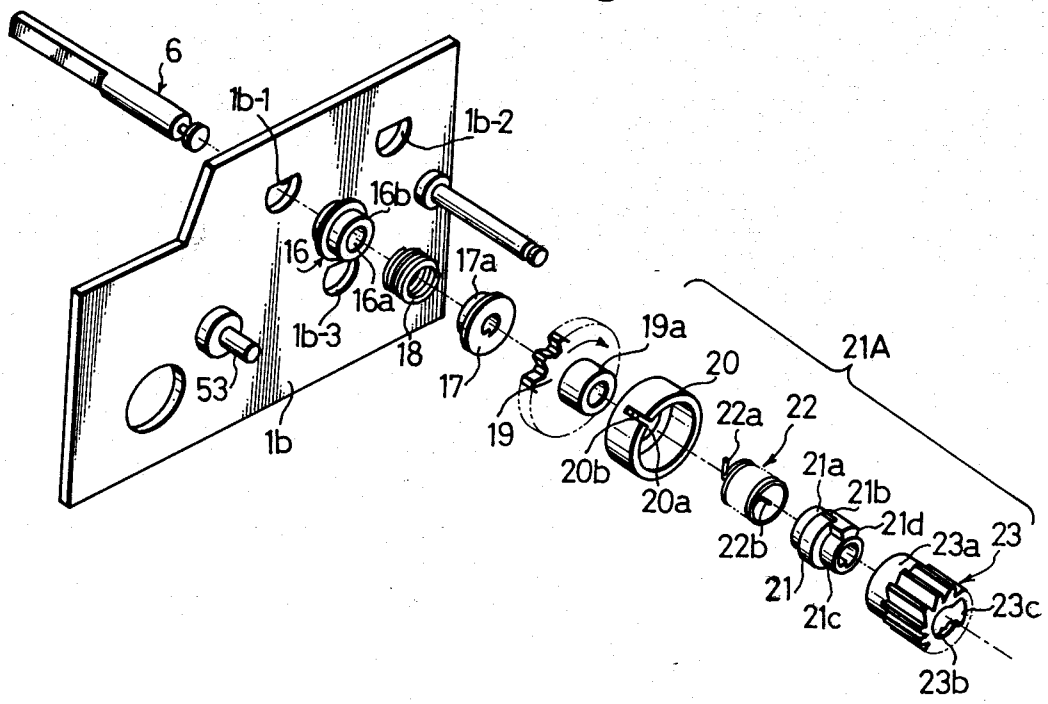
FIG. 2 is an exploded perspective view of a rotary shaft mechanism (first clutch) in the printer of FIG. 1.

The driving mechanism for rotatably driving the type wheels 4 and 5 is illustrated in FIG. 2, wherein reference numeral 16 denotes a stationary bearing received within a semicircular bore 1*b*-1 formed in the side plate 1*b* so as not to be able to rotate with respect to the latter. The bearing 16 has a central bore 16*a* for receiving the rotary shaft 6. An anti-reversing ring 17 is rigidly fitted to the rotary shaft 6 so as to rotate unitarily with the latter. An anti-reversing coiled spring 18 is coiled such that it is unwound as the rotary shaft 6 is rotated in the proper direction. The stationary bearing 16 and the anti-reversing ring 17 are provided with drum portions 16*b* and 17*a* of an equal diameter and kept in close contact with each other at their side surfaces. The coiled spring 18 is wound around these drums. The inside diameter of the coiled spring 18 is slightly smaller than the outside diameter of each drum. The coiled spring 18 is unwound as the rotary shaft 6 rotates in the proper direction, so that the drums 16*b* and 17*a* are disengaged from the spring and tus each other. However, if the rotary shaft 6 is rotated in the wrong direction even by a small angle, the coiled spring 18 tightens against the drums 16*b* and 17*a* to connect them to each other thereby to prevent the reversing of the rotary shaft 6.

The drawings also show a clutch assembly 21A with a portion thereof being omitted. A gear 19 loosely fitted to the rotary shaft 6 has a drum 19*a*. A holding sleeve 20 has at its one side a bore 20*a* penetrated by the drum 19*a*, and provided at its peripheral surface with a groove 20*b*. A cylinder 21 is provided at its one side with a drum 21*a* and at its peripheral surface with a groove 21*b*. Although not fully illustrated, a coiled spring 22 has its respective ends 22*a* and 22*b* bent as shown. A ratchet gear 23 is provided at its one side with a boss 23*a* and has an internal cavity for receiving parts of the aforementioned clutch assembly 21A.

For assembling the clutch assembly 21A, at first one end 22*b* of the coiled spring 22 is inserted into the groove 21*b* of the cylinder 21 and almost half of the coiled spring 22 is fitted around the drum 21*a* of the cylinder 21. (The inside diameter of the coiled spring 22 is slightly smaller than the common outside diameter of the drums 19*a* and 21*a*). Then, the drum 19*a* of the gear 19 is loosely inserted through the bore 20*a* of the holding sleeve 20 to project from the latter and the remainder part of the coiled spring 22 is press-fitted onto the drum 19*a*. At the same time, the other end 22*a* of the coiled spring is inserted into the groove 20*b* of the holding sleeve 20. In consequence, the members 19 and 20 are coupled to each other through the coiled spring 22 so as to be rotated unitarily in a predetermined direction. During assembly, the holding sleeve 20 is rotated slightly with respect to a ratchet gear 23 which will be explained later, so as to absorb the fluctuation of the angular distance between both ends 22*a* and 22*b* of the coiled spring 22 which inevitably takes place during manufacturing of the spring.

Then, the cylinder 21 is press-fitted into the rotary shaft 6 and then the ratchet gear 23 is fitted around the cylinder 21, such that a sector projection 21*d* on the outer circumferential surface of drum 21*c* of the cylinder 21 aligns with a sector bore 23*c* communicating with the central bore 23*b* of the end of the ratchet gear 23. The holding sleeve 20 is adjusted and rotated while engaging the sector projection 21*d* and sector bore 23*c* to effect the alignment of the attaching position. A certain margin is preserved for mutual engagement between the sector projection 21*d* and the sector bore 23*c* so as to smooth the movement of the coiled spring in the tightening and loosening directions during the operation of the clutch which will be described later.

The aforementioned coiled springs 18 and 22 are set in the opposite winding directions with respect to one another. In this way, the rotation of the gear 19 caused by a later-mentioned motor is transmitted to the rotary shaft 6 via the cylinder 21 through the connection of the coiled spring 22 wound tightly on the drives 19*a* and 21*a*. On the other hand, as the rotation of the ratchet gear 23 is checked by a checking member to be described below, the cylinder 21 is also stopped so that the coiled spring 22 is slacked without delay to interrupt the connection between the gear 19 and the cylinder 21, i.e. the rotary shaft 6. If the rotary shaft 6 tends to rotate in the direction reverse to the direction caused by the motor, the aforementioned coiled spring 18 is tightened without delay to rigidly connect the stationary bearing 16 and the anti-reversing ring 17, thereby to prevent reverse rotation of the rotor shaft 6.

Figure 3:
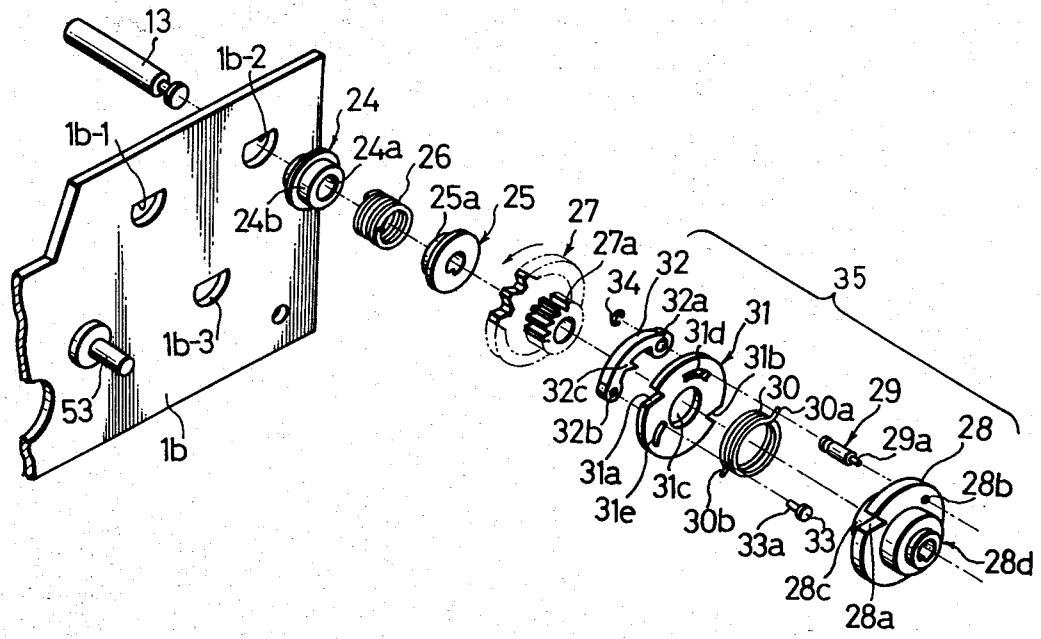
FIG. 3 is an exploded perspective view of a hammer driving mechanism (second clutch) in the printer of FIG. 1.

The shaft mechanism for rotatably driving the hammer cam 12 for the typing hammer is shown in FIG. 3, and includes a stationary bearing 24 received within a semicircular bore 1*b*-2 formed in the side plate 1*b* so as not to be able to rotate relative to the latter, and has a central bore 24*a* receiving the drive shaft 13. An anti-reversing ring 25 is rigidly fitted to the drive shaft 13 so as to be rotated unitarily with the latter. An anti-reversing coiled spring 26 is wound in such a direction as to be unwound as it is twisted in the proper direction of rotation of the drive shaft 13. The stationary bearing 24 and the anti-reversing ring 25 are provided with respective drums 24*b* and 25*a* of an equal diameter which are kept in close contact with each other at their facing sides. The aforementioned coiled spring 26 is wound round these drums. The coiled spring 26 has an inside diameter slightly smaller than the outside diameter of these drums. As the drive shaft 13 is rotated in the direction of the arrow, the coiled spring 26 is driven in the unwinding direction so that the drums 24*b* and 25*a* are disconnected from each other. However, if the drive shaft 13 is reversed even by a small angle of rotation, the coiled spring 26 tightens against the drums 24*b* and 25*a* to connect these drums thereby to prevent the rotation of the drive shaft 13 in the reverse direction. Although not fully illustrated, a gear 27 loosely carried by the drive shaft 13 is provided at its one side with a ratchet gear 27*a* formed unitarily therewith or fixed thereto.

A clutch 35 is formed by a clutch disk 28 fixed to the drive shaft 13 so as to rotate unitarily with the latter. The clutch disk 28 is provided in its periphery with two diametrically opposing notches 28*a* and 28*d* and, at its one side, with a hole 28*b* for fixing the end 29*a* of a pin 29. The clutch disc 28 is further provided at its one side with a drum 28*c* for receiving a coiled spring 30, both ends 30*a* and 30*b* of which are bent outwardly as shown. A checking plate 31 is provided in its periphery with two diametrically opposing notches 31*a* and 31*b* and has a central bore 31*c* for receiving the drive shaft 13. The checking plate 31 is further provided with a circumferentially elongated hole 31*d* and a radially elongated hole 31*e*. A reference numeral 32 denotes a ratchet pawl at both ends of which are formed respective bores 32*a* and 32*b*. Also, a pawl 32*c* is formed at the center. Reference numeral 34 denotes a split washer.

For assembling the clutch 35, the end 29*a* of the pin 29 is inserted into the bore 28*b* of the clutch disk 28 so as to be fixed by the latter, while the reduced-diameter portion 33*a* of a pin 33 is inserted into the elongated bore 31*e* of the checking plate 31. Thereafter, the reduced diameter portion 33*a* of the pin 33 is fitted and fixed to the hole 32*b* of the ratchet pawl 32. Then, the coiled spring 30 is fitted round the body portion 28*c* of the clutch disk 28 and the end 30*a* of this spring is retained by the pin 29. Subsequently, the circular bore 31*c* of the checking plate 31 is fitted to the body portion 28*c*. In this state, the pin 29 is introduced into the hole 32*a* of the ratchet pawl 32 through the elongated bore 31*d* in the checking plate 31, and the end 30*b* of the coiled spring 30 is retained by the reduced diameter portion 33*a* of the pin 33. Finally, the washer 34 is fitted to the end of the pin 29.

A drive shaft 13 is inserted into the center of the clutch 35 thus assembled, and the clutch disk 28 and the drive shaft 13 are coupled to each other. At the same time, the ratchet gear 27*a* and the pawl 32*c* are made to engage with each other.

As the gear 27 is rotated from this state in the direction of the arrow, the ratchet gear 27*a* engages and pulls the pawl 32 so that the clutch disk 28 is also rotated to drive the drive shaft 13. In the course of rotation, the notch 28*a* and the notch 31*a* may be engaged by claws not shown, and the rotation of the clutch disk 28 and the checking plate 31 is stopped so that the ratchet gear 27*a* of the 27 comes to push the ratchet pawl 32 since the gear 27 is rotated continuously by the motor. In consequence, the ratchet pawl 32 is moved outwardly as the respective pins slide within the elongated bores 31*d* and 31*e* so that the ratchet gear 27 is disengaged from the ratchet pawl 32. The connection between the gear 27 (i.e. the motor) and the clutch disk 28 (i.e. the drive shaft 13) is thereby broken. Movement of the drive shaft 13 in the reverse direction is prevented by the anti-reversing mechanism constituted by the aforementioned coiled spring 26.

Figure 4:
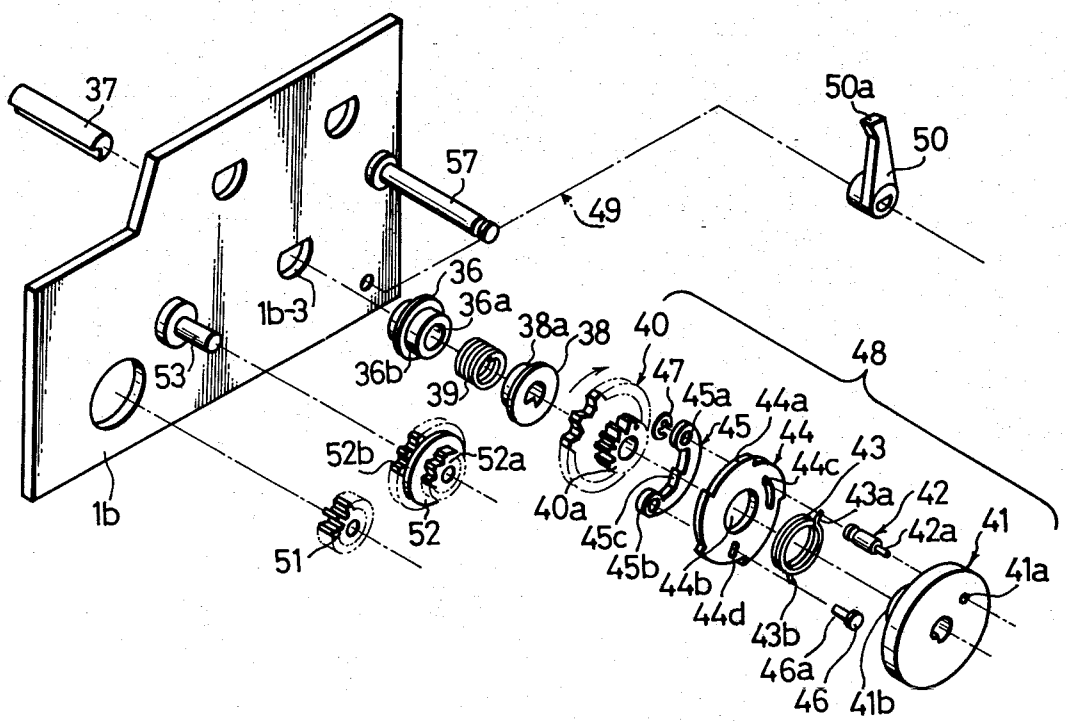
FIG. 4 is an exploded perspective view of a paper feed mechanism (third clutch) in the printer of FIG. 1.

The mechanism for feeding the recording paper is shown in FIG. 4, wherein a stationary bearing 36 is fitted to a semicircular bore 1b-3 formed in the side plate 1b so as not to be able to rotate with respect to the latter, and has a central bore 36a for receiving a paper feed shaft 37. A reference numeral 38 denotes an anti-reversing ring which is fitted to the paper feed shaft 37 so as to be rotated unitarily with the latter. An anit-reversing coiled spring 39 is wound in such a direction as to be unwound as it is twisted in the direction of rotation of the shaft 37. The stationary bearing 36 and the anti-reversing ring 38 are provided with respective drums 36b and 38a which are closely contacted by each other at their facing ends. The aforementioned coiled spring 39 is wound on these drums. The inside diameter of the spring 39 is slightly smaller than the outside diameters of these drums. The arrangement is such that the coiled spring 39 is driven in slacking or unwinding direction when the paper feed shaft 37 rotates in the proper direction, so that the connection between the drums 36b and 38a is broken. However, if the paper feed shaft 37 is rotated in the reverse or wrong direction even by a small angle, the coiled spring 39 tightens against the drums 36b and 38a so that these drums are operatively connected to each other to prevent reverse rotation of the paper feed shaft 37.

Although not fully illustrated, a clutch 48 is formed by a gear 40 loosely mounted on the paper feed shaft 37. The gear 40 is provided with a ratchet gear 40a fixed to one side thereof. A clutch disk 41 has a hole 41a for fixedly receiving a reduced diameter portion 42a of the pin 42, and a hub portion 41b at one side thereof for receiving a coiled spring 43 therearound. The ends 43a and 43b of the coiled spring 43 are bent outwardly as shown. A checking plate 44 is provided with 5 (five) teeth 44a formed on the outer periphery thereof, and has a central circular bore 44b through which the paper feed shaft 37 passes. The checking plate 44 is further provided with a circumferentially elongated bore 44c and a radially elongated bore 44d. A reference numeral 45 denotes a ratchet pawl at both ends of which are formed respective holes 45a and 45b. Also, a pawl 45c is formed at the central portion of the ratchet pawl 45. Reference numerals 46 and 47 denote, respectively, a pin and a washer.

For assembling the clutch 48, the end 42a of the pin 42 is fitted and fixed in the hole 41a of the clutch disk 41 and the reduced diameter portion 46a of the pin 46 is fitted and fixed in the hole 45b of the ratchet pawl 45, through fthe elongated bore 44d of the checking plate 44. Then, the coiled spring 43 is wound round the hub portion 41b of the clutch disk 41, and one end 43a thereof is retained by the pin 42. Subsequently, the hub portion 41b is fitted in the circular bore 44b of the checking plate 44. In this state, the pin 42 is inserted into the hole 45a of the ratchet pawl 45 through the elongated bore 44c of the checking plate 44, and the end 43b of the coiled spring 43 is retained by the reduced diameter portion of the pin 46. Finally, the washer 47 is fitted to the end of the pin 42.

The paper feed shaft 37 is inserted into the center of the clutch 48 thus assembled, and the clutch disk 41 is rigidly fitted to the paper feed shaft 37. At the same time, the ratchet gear 40a and the pawl 45c are made to engage with each other. The claw 50a provided at one end of an arm 50 fixed to a paper-feed instruction shaft 49 supported by the side plate 1b may be brought into engagement with the teeth 44a of the checking plate 40 to check the rotation of the latter, as will be set forth more fully below. A reference numeral 51 denotes a pinion attached to the motor shaft of a driving motor which is not shown, whereas a reference numeral 52 denotes an intermediate gear (not shown fully) carried by a shaft 53 which in turn is attached to the side plate 1b. The gear portion 52a of the gear 52 meshes with the pinion 51 while the gear portion 52b meshes with the gear 40.

As the gear 40 is rotated in this state, the ratchet gear 40a engages and pulls the ratchet pawl 45, and the clutch disk 41 is checked by the mutual engagement between the claw 50a and the checking plate 44, although it tends to rotate. As a further force is applied to cause the rotation, the ratchet pawl 45 slides outwardly as the pins 42 and 46 move within the bores 44c and 44d of the checking plate 44, so that the pawl 45c is moved out of engagement with the ratchet gear 40a. In this state, the gear 40 idles without being accompanied by the rotation of the shaft 37. As the arm 50 is rotated in response to a paper feed instruction to temporarily disengage the claw 50a from the teeth 44a of the checking plate 44, the ratchet pawl 45 is moved to again bring the pawl 45c into engagement of the ratchet gear 40 *a* and the paper feed shaft 37 is rotated by the gear 40 and, after the completion of the feed of paper (when the checking plate 44 has made a 1/5 rotation), the claw 50a is brought again into engagement with the teeth 44a by the force of a spring, so that the rotation of the gear 40 is interrupted by the clutch 48 to stop the paper feed shaft 37.

Three major rotary shafts of the serial printer of the invention have been described. In the assembled state of these three shafts, the gear 40 carried by the paper feed shaft 37 engages the gear 27 carried by the drive shaft 13, and the gear 27 in turn is engaged by the gear 19 carried by the rotary shaft 6, so that the rotation of the gear 51 is finally transmitted to the gear 19 to make these gears rotate simultaneously.

Figure 5:
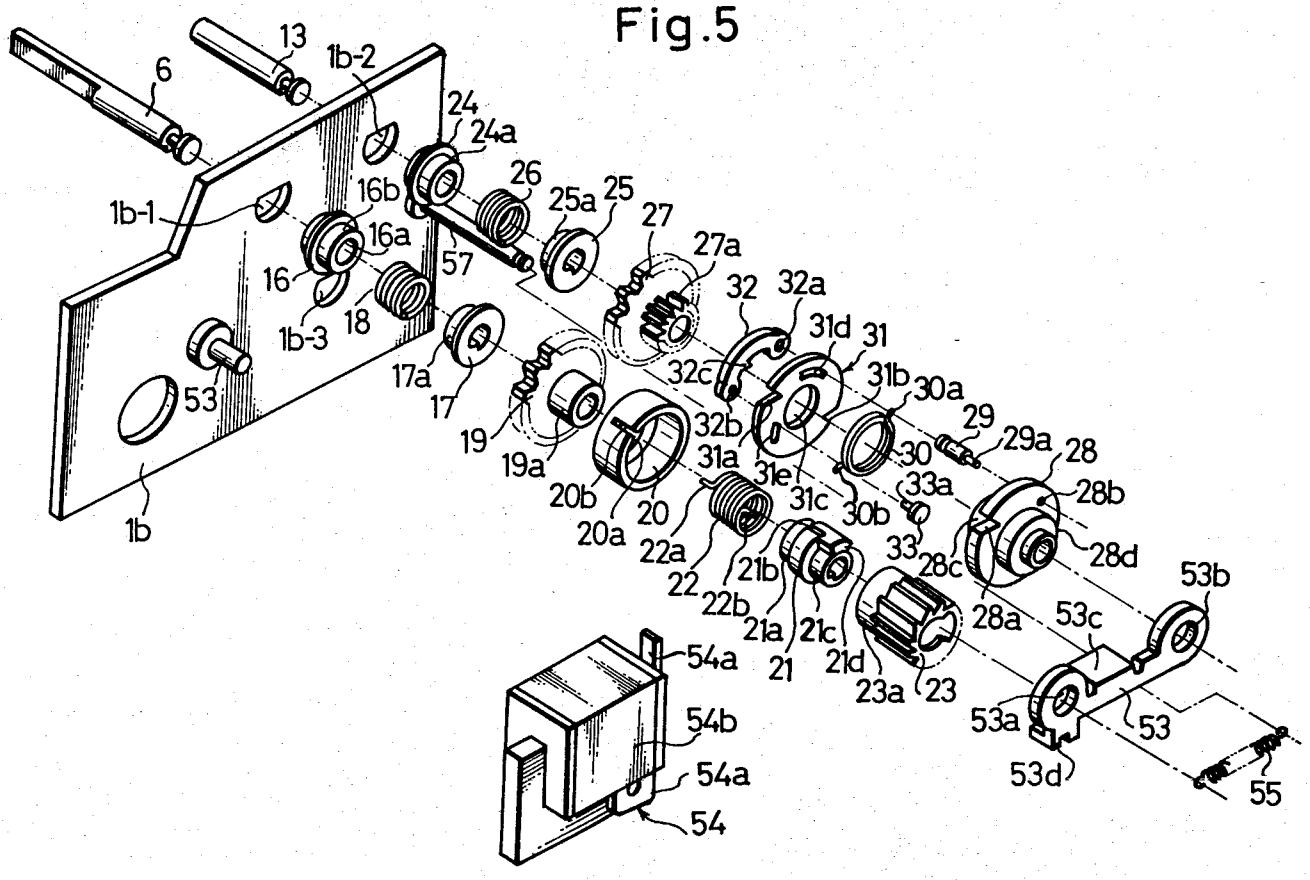
FIG. 5 is an exploded perspective view showing the rotary shaft mechanism, hammer driving mechanisms and a controlling mechanism for driving both mechanisms.

A change-over mechanism for changing over the clutches on the rotary shaft 6 and the drive shaft 13 is provided on the side plate 1b. In FIG. 5, a reference numeral 53 denotes a changeover plate of this mechanism. Also, reference numerals 54 and 55 designate a driving magnet and a tension spring incorporated in this mechanism. The change-over plate 53 is provided at its both end portions with oversized bores 53a and 53b as shown, and has a retaining tab 53c formed centrally. Further, a slit 53d is formed at the lower part of the elongated bore 53a. The change-over plate 53 is carried by the rotary shaft 6 and the drive shaft 13 received within the elongated bores 53a and 53b, respectively. The change-over plate 53, however, is free to move laterally between the shaft 6 and 13. The arrangement is such that, when the changeover plate 53 is located at one end of its stroke, the engaging tab 53c engages the ratchet gear 23, whereas, when the changeover plate is located at the other end, the engaging tab 53c engages the notch 31a of the checking plate 31 and the notch 28a of the clutch disc 28. The driving magnet 54 carries the arm 54a which is attracted by the solenoid coil 54b overcoming the force of the spring 55 as the solenoid coil 54b is energized.

Figure 6:
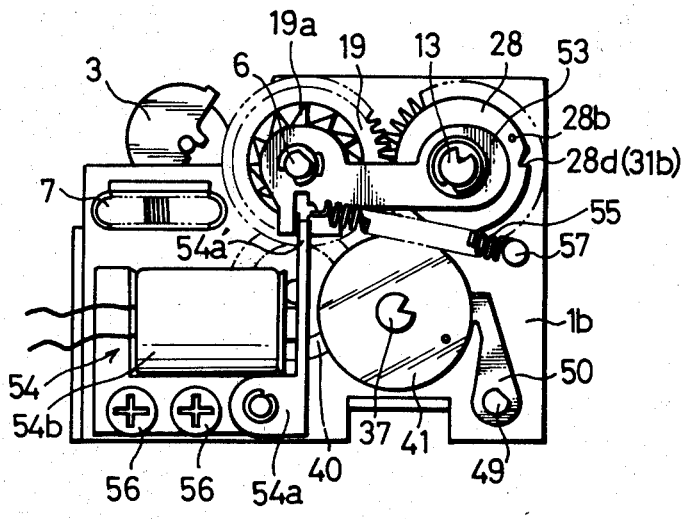
FIG. 6 is a right-side elevational view of the printer as seen from the right side thereof with a part of the printer being shown schematically.

As will be seen from FIG. 6 which shows the side elevation of the typing mechanism as viewed from the same side as the side plate 1b, with parts thereof being omitted, the driving magnet 54 is fixed to the side plate by means of screws 56 with the end portion 54a' of the arm 54a fitting within the slit 53d of the change-over plate 53, while the tension spring 55 is stretched between the arm 54*a* and a post 57 provided on the side plate 1*b*. When the magnet 54 is not energized, the spring keeps the engaging tab 53*c* in engagement with the clutch disc 28 and the checking plate 31.

Figure 7:
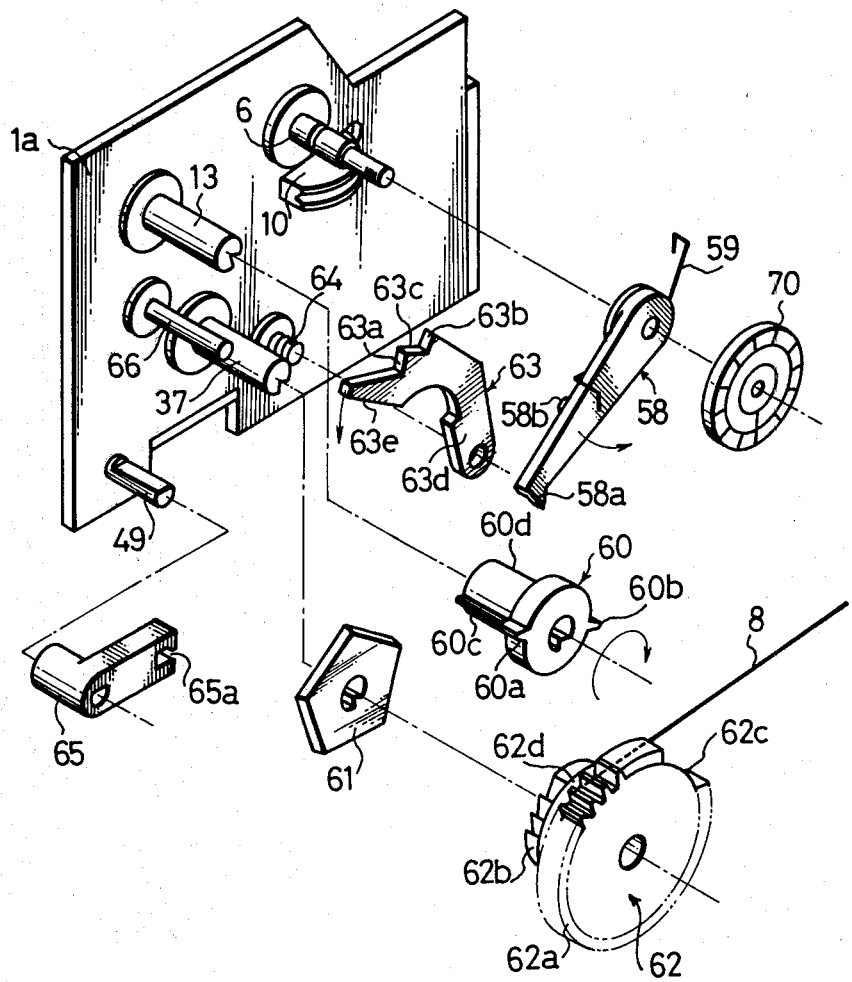
FIG. 7 is an exploded perspective view of the printer of FIG. 1 as seen from the left side thereof.

FIG. 7 is an exploded perspective view of mechanisms located at the same side as the side plate 1*a*, in which a reference numeral 58 denotes a retainer arm carried by the rotary shaft 6 for free rotation regardless of the rotation of the rotary shaft 6. A coiled spring 59 normally biases the arm 58 rotatively in the direcion of the arrow. The retainer arm 58 is provided at its end with a pawl 58*a*, and a projection 58*b* extends outwardly from an intermediate portion thereof. A reference numeral 70 denotes a rotary encoder disc fixed to the rotary shaft 6. A feed pawl 60 fixed to the drive shaft 13 has two claws 60*a* and 60*b* and kick claws 60*c* and 60*d*, diametrically opposed. A pentagonal cam 61 is fixed to the paper feed shaft 37 for rotation unitarily with the latter, while a wind-up gear 62 (gear portion being illustrated only partially) is carried also by the paper feed shaft 37 but is allowed to rotate independently of the latter.

The wind-up gear 62 is provided with a gear portion 62*a* and a ratchet gear 62*b*. The teeth of the gear portion 62*a* are eliminated over a certain circumferential length to form a teethlacking portion 62*c*.

A drum 62*d* is formed between the ratchet gear 62*b* and the gear portion 62*a*, around which drum is wound the column shift wire (or thread) 8 connected to the carriage 3. A reference numeral 63 denotes a releasing arm rotatably carried by a shaft 64 provided on the side plate 1*a*. The releasing arm 63 is provided with two cam valleys 63*a* and 63*b* and one cam ridge 63*c*, as well as a projection 63*d* formed beneath the latter. An engaging arm 65 fixed to a paper-feed instruction shaft 49 is provided at its end with a slit 65*a*. A reference numeral 66 denotes a guide post formed on the side plate 1*a*, the end of which is fitted to a slit (not shown) formed in the back side of the wind-up gear 62 to act as a stopper member for determining the initial position of the winding-up gear.

In the assembled state of the parts located at the same side as the side plate 1*a*, when the carriage 3 is at the initial position, the projection 58*b* of the retaining arm 58 fits within the cam valley 63*a* of the releasing arm 63 so that the pawl 58*a* of the latter is kept away from the ratchet gear 62*b*, and the winding-up gear 62 is thus in a free state. Also, the projection 63*d* of the releasing arm 63 is kept in contact with a flat surface of the cam body 61.

Figure 8:
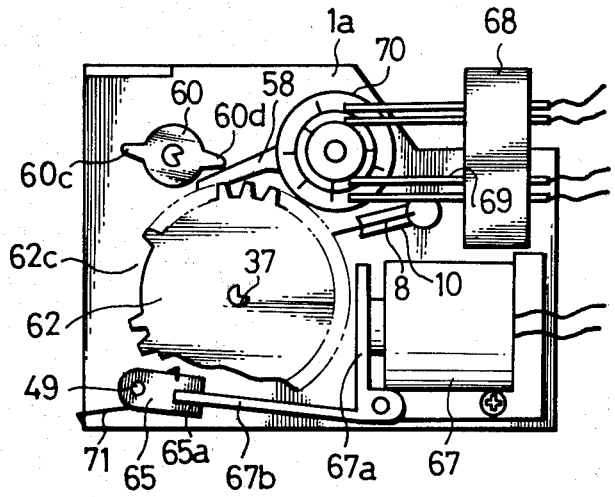
FIG. 8 is a left-side elevational view of the printer of FIG. 1 with a part thereof shown schematically.

FIG. 8 shows the typing mechanism in side elevation as viewed from the same side as the side plate 1*a*, with parts thereof being omitted for simplicity. As will be seen from this Figure, the slit 65*a* of the engaging arm 65 loosely receives the end 67*b* of the actuating arm 67*a* of solenoid 67 which is adapted to be energized when an instruction is given to advance the record paper. A reference numeral 68 denotes a terminal plate having contact pieces 69 for contacting the rotary encoder disc 70.

A series of typing operations performed by the serial printer of the invention will be described hereinafter.

As the motor starts to rotate in response to a typing instruction, from the state in which the carriage 3 is at the rightmost position, i.e. at the initial position as shown in FIG. 1, all of the gears 19, 27 and 40 provided on the three shaft mechanisms start to rotate. Since the clutch 21A associated with the gear 19 is in the connected state, the ratchet gear 23 and the rotary shaft 6 are rotated so that the rotary encoder disc 70, as well as the type wheels 4 and 5 are rotated.

Figure 9:
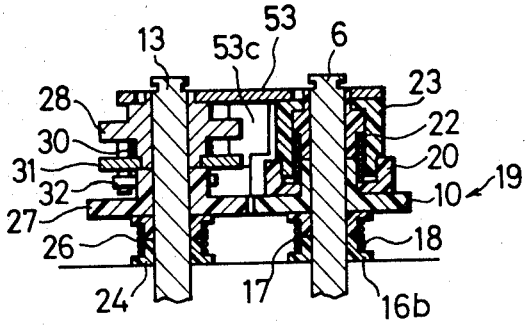
FIG. 9*a* and 9*b* are sectional plan views of the printer of FIG. 1 for explaining the operation of the printer.
Figure 9:
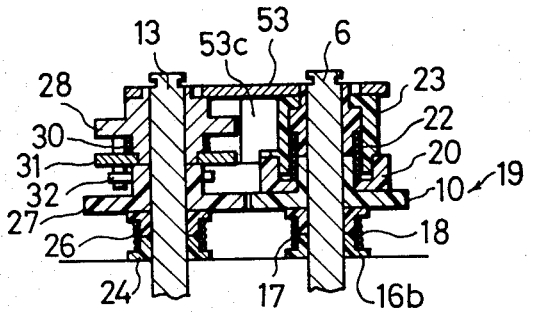

Then, as the desired function type is brought to the typing position, the driving magnet 54 (See FIG. 6) is energized to move the change-over plate 53 to the left as viewed in FIG. 6. In consequence, the engaging tab 53*c* of the change-over plate 53 engages the ratchet gear 23 to stop the latter. FIGS. 9*a* and 9*b* show the states of the mechanism before and after the movement of the change-over plate 53, respectively. As mentioned before, as the ratchet gear 23 is stopped, the clutch 21A on the rotary shaft 6 is turned into its disengaged state, so that the rotary shaft 6 stops to rotate, allowing the gear 19 to rotate idly.

On the other hand, the movement of the change-over plate 53 causes the engaging tab 53*c* of the latter to be disengaged from the notches 28*a* and 31*a* of the clutch 35 (See FIG. 3), so that the clutch 35 is turned into its connecting condition to cause the drive shaft 13 to rotate. Then, at the initial period of the rotation, the hammer cam 12 presses the typing hammer 11 (See FIG. 1) to effect the typing to the function symbol.

As the drive shaft 13 rotates further, referring to FIG. 7, the feed pawl 60 is rotated in the direction of arrow so that a kick claw 60*c* (or 60*d*) drives the end 63*e* of the releasing arm 63 downwardly thereby to rotate the latter to place the projection 58*b* of the retaining arm 58 in the cam valley 63*b*. Consequently, the retaining arm 58 is rotated in the direction of arrow to bring the claw 58*a* into engagement with the ratchet gear 62*b* to check the rotation of the wind-up gear 62. Thereafter, the kick claws 60*c* and 60*d* cannot contact the releasing arm 63 until the carriage 3 is returned. As the feed pawl 60 is further roated, another claw 60*a* of 60*b*, which has a phase difference from the kick claw, is brought into engagement with the gear portion 62*a* to cause the wind-up gear 62 to rotate through a small arc of one pitch. The rotation of the wind-up gear 62 in turn causes the column shift wire 8 to be taken-up by the drum portion 62*d* so that the carriage is subjected to a column shift. The above-explained series of operations is performed during a half rotation of the drive shaft 13. Meanwhile, the driving magnet 54 is de-energized so that the change-over plate 53 is pulled and returned to the right as viewed in FIG. 6 by the force of the tension spring 55. After the half rotation of the drive shaft 13, the engaging tab 53*c* comes into engagement with the notches 28*d* and 31*b* (or 28*a* and 31*a*) of the clutch 35 and is thus disengaged from the ratchet gear 23. In consequence, the clutch 21A and the clutch 35 are turned into connecting and disconnecting states, respectively, so that the rotary shaft 6 rotates to cause the rotation of the type wheels 4 and 5, while the rotation of the drive shaft 13 is suspended.

As the numeral which is to be typed in the second column is brought to the typing position, the driving magnet 54 is energized again to move the change-over plate 53 to move to the left as viewed in FIG. 6, so that the engaging tab 53*c* of the change-over plate 53 comes to mesh with the ratchet gear 23 to stop the latter, which in turn causes the clutch 21A on the rotary shaft 6 to be turned into disconnecting state so that the rotary shaft 6 is stopped allowing the gear 19 to idle.

On the other hand, as the change-over plate 53 is moved, the engaging tab 53*c* of the latter is disengaged from the notches 28*b* and 31*d* of the clutch 35 so that the clutch 35 is turned into connecting state to drive the drive shaft 13 thereby to make the hammer cam 12 press the typing hammer 11 to type the aforesaid numeral.

Referring again to FIG. 7, as the drive shaft 13 is rotated, the feed pawl 60 is rotated in the direction of the arrow to bring the claw 60*a* (or 60*b*) into engagement with the teeth as explained before. This in turn causes the drum 62 to wind-up the column shift wire 8 so that the carriage 3 is shifted by a further one column overcoming the force of the tension spring 7. As the feed pawl 60 makes a half rotation, the claw 60*a* and the gear 62*a* are disengaged from each other to complete the column shift operation by one column. Meanwhile, the driving magnet 54 is de-energized to permit the change-over plate 53 to be shifted to the right as viewed in FIG. 6 by the force of the tension spring 55 and, after a half rotation of the drive shaft 13, the latter comes into engagement with the notches 28*a* and 31*a* (or 28*d* and 31*b*) of the clutch 35 and is disengaged from the ratchet gear 23. In consequence, the clutch 21A and the clutch 35 are turned into connecting and disconnecting states, respectively, so that the rotary shaft 6 is rotated to cause rotation of the type wheels 4 and 5, while the drive shaft 13 is stopped to complete the typing of the numeral in the second column.

This typing operation is repeated to effect the typing of the desired number of columns. As the typing is finished with one line, the solenoid 67 (See FIG. 8) is energized to cause a clockwise rotation of the actuating arm 67*a*, so that the engaging arm 65 is kicked up to rotate in the counter-clockwise direction overcoming the force of the spring 71, thereby to cause a rotation of the paper-feed instruction shaft 49.

Figure 10:
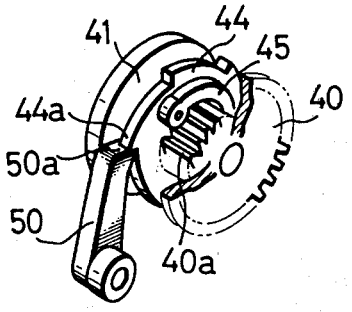
FIGS. 10 and 11 are exploded perspective views for explaining the operation of the clutch of the paper feed mechanism.
Figure 11:
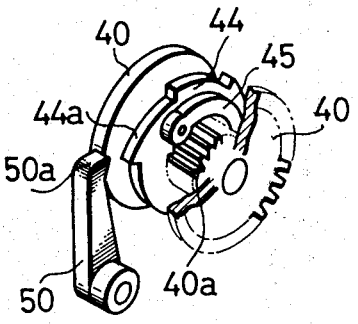

In consequence, the arm 50 located at the same side as the plate 1*b*, adapted to rotate unitarily with the shaft 49, is rotated so that the claw 50*a* which has been engaged by the teeth 44*a* of the retaining plate 44 as shown in FIG. 10 is temporarily moved out of engagement with the teeth 44*a* to turn the clutch 48 into connecting state. In consequence, the paper feed shaft 37 starts to rotate to feed the recording paper 14 by one pitch.

Figure 12:
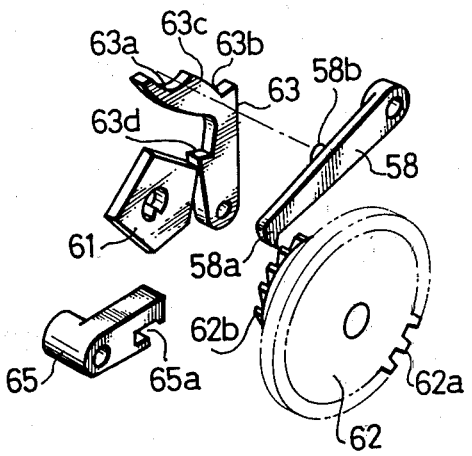
FIG. 12 is an exploded perspective view of a winding-up mechanism of the printer in accordance with the invention.

As the paper feed shaft 37 starts to rotate, cam body 61 (See FIG. 7) unitary with the latter is rotated to push up the projection 63*d* of the releasing arm 63 as shown in FIG. 12. This motion in turn causes the projection 58*b* of the retaining arm 58 to moved from the cam valley 63*b* to the cam valley 63*a* thereby to disengage the claw 58*a* and the ratchet gear 62*b* from each other to free the wind-up gear 62. In the state where the projection 53*b* of the retaining arm 58 engages the valley 63*a* of the releasing arm 63, both members 58 and 63 are in the dynamically balanced state which is maintained until the releasing arm 63 is depressed by the kick claws 60*c* and 60*d* of the aforementioned feed pawl 60, thereby to ensure the correct returning operation of the carriage. As the gear 62 is freed, the carriage 3 is normally pulled by the tension spring 7 toward the initial position, so that the carriage returns to the initial position without delay, pulling the column shift wire 8 which in turn rotates the wind-up gear 62 to reset the latter to the starting position.

As has been described, in the typing mechanism of the invention, the rotary driving mechanism for driving the type wheels and the driving shaft mechanism for driving the typing hammer are brought into the sequential operation by the actions of various clutches. This arrangement offers various advantages. For instance, the number of the driving sources is reduced. In addition, it is possible to obtain a serial printer of reduced size and weight and having a high typing speed, because it is possible to maintain a constant direction of rotation of the motor shaft. In addition, the mechanism is very simple and operates at a high reliability, because the change-over of the clutches is performed by the member selecting the symbols or numerals of the type wheels.

We claim:

1. A printer comprising:

a motor;

a rotary shaft adapted to be rotated unitarily with type wheels and adapted to be driven rotatably by said motor;

first clutch means for selectively transmitting the rotation of said motor to said rotary shaft;

a hammer member adapted to be moved into and out of contact with said type wheels;

a hammer drive shaft adapted to be driven by said motor and carrying a cam member for actuating said hammer member;

second clutch means adapted for selectively transmitting the rotation of said motor to said hammer drive shaft, control means for controlling said first and second clutch means simultaneously to engage one of said clutch means while disengaging the other; further comprising a carriage carrying said type wheels and slidable in a direction parallel to said rotary shaft;

a spring member connected to one end of said carriage and adapted to urge said carriage toward the initial position;

a thread member connected to the other end of said carriage; and means adapted to gather said thread means to overcome the force of said spring member, said gathering means being actuated by rotation of said hammer drive shaft when the latter is driven through said second clutch means.

2. A printer as claimed in claim 1, wherein said gathering means include a drum for winding-up said thread member, said drum being engaged by a gear fixed to said hammer drive shaft.

3. A printer as claimed in claim 1, wherein said first and second clutch means have respective ratchets adapted to be engaged by said control means.

4. A printer as claimed in claim 3, wherein said control means includes a solenoid and means including a lever adapted to be actuated by said solenoid for selectively engaging said ratchets of said first and second clutch means.

5. A printer comprising:

a motor adapted to rotate a motor shaft in one direction only;

a carriage movable slidably along a line to be printed;

a spring member connected to said carriage for continously biasing said carriage toward the initial position on said line;

a thread member connected to said carriage and adapted to pull said carriage toward the last position on said line;

a rotary drum for winding-up said thread member by overcoming the biasing force of said spring member;

a feed mechanism including clutch means for selectively transmitting the rotation of said motor shaft to said rotary drum to rotate said rotary drum and draw said carriage towards said last position;

An arm engaging said gear of said rotary drum and adapted to prevent said rotary drum from being rotated by the force of said spring;

a releasing means adapted to keep said arm in the state separated from said gear of said rotary drum when said carriage is returned to said initial position; and means for maintaining said arm separated from said gear over a predetermined period of time when said carriage has been returned to said initial position by means of said releasing means.

6. A printer as claimed in claim 5, wherein said means for maintaining said arm separated from said gear over a predetermined period of time includes: a releasing arm engaging said arm and movable between a first position and a second position; a cam member adapted to move said releasing arm from said first position to said second position in response to the rotation of paper feed shaft; and a member for driving said releasing arm from said second position to said first position in response to the operation of said feed mechanism.

7. A printer including a carriage movable along a printing line and including a type wheel rotatable by a rotary shaft for positioning a selected one of a plurality of type elements carried by said type wheel into a printing position along said printing line, said carriage being connected to a spring member urging it towards its initial position along said printing line;

a motor;

means including a first clutch for selectively transmitting the rotary motion of said motor to said rotary shaft;

a hammer having a hammer surface extending longitudinally along said printing line and movable towards said type wheel by rotation of a hammer shaft;

means including a second clutch for selectively transmitting the rotary motion of said motor to said hammer shaft;

means for shifting said carriage along said printing line upon engagement of said second clutch; and control means connected to said first clutch and said second clutch for engaging one while simultaneously disengaging the other to enable said type wheel to be rotated by said motor to position a selected type element along said printing line upon engagement of said first clutch and thereafter disengage said first clutch and engage said second clutch to move said hammer toward the selected type element and thereafter shift said carriage to the next printing position along said printing line.

8. A printer according to claim 7, said means for shifting said carriage comprising:

a thread member connected to said carriage; and means adapted to gather said thread means to overcome the force of said spring member, said gather means being actuated by rotation of said hammer shaft when the latter is driven through said second clutch.

* * * * *

UNITED STATES PATENT AND TRADEMARK OFFICE

CERTIFICATE OF CORRECTION

PATENT NO. : 4,352,576

DATED : October 5, 1982

INVENTOR(S) : HORI et al.

It is certified that error appears in the above—identified patent and that said Letters Patent is hereby corrected as shown below:

On the cover page:

The Assignee has been changed to Alps Electric Co., Ltd., Tokyo Japan.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*